US005700350A

United States Patent [19]

Guo

[11] Patent Number: 5,700,350

[45] Date of Patent: Dec. 23, 1997

[54] PROCESSES OF RETAINING CHELANT-CONTAINING EFFLUENT WITHIN PULP BLEACH PLANTS

[75] Inventor: Ruijin Guo, Vancouver, Canada

[73] Assignee: Chemetics International Company Ltd., Vancouver, Canada

[21] Appl. No.: 623,360

[22] Filed: Mar. 28, 1996

[51] Int. Cl.[6] ..... D21C 11/00

[52] U.S. Cl. ..... 162/29; 162/79; 162/DIG. 8

[58] Field of Search ..... 162/29, 76, DIG. 8

[56] References Cited

U.S. PATENT DOCUMENTS 5,401,362 3/1995 Lindberg ..... 162/37
5,545,331 8/1996 Guess ..... 210/713

FOREIGN PATENT DOCUMENTS

92/23122 10/1994 WIPO .

OTHER PUBLICATIONS

Brooks, et al: "Filtrate Recycle and Metals Management in TCF Bleach Plants", International Non–Chlorine Bleaching Conference Proceedings, paper 8–1, Mar. 1995.

Maples, et al: BFR:"A New Process Toward Bleach Plant Closure", International Pulp Bleaching Conferecne, p. 253, Jun. 1994.

Lindberg, et al: "Strategies for Metal Removal Control in Closed Cycle Mills", International Pulp Bleaching Conference, pp. 293–302, 1994.

*Primary Examiner*—Peter Chin
*Assistant Examiner*—Dean T. Nguyen
*Attorney, Agent, or Firm*—Cushman Darby & Cushman IP Group Pillsbury Madison & Sutro LLP

[57] ABSTRACT

Improved environmentally acceptable process for retaining chelant-containing effluent within pulp bleach plants, particularly total chloride-free bleaching sequence plants using a chelating agent closed re-cycle process. The process involves treating a pulp liquor in an acidic or near neutral stage with an effective chelating amount of a chelating agent to form a soluble, chelated metal species; removing the pulp to provide a chelated metal species-containing solution; treating this solution in an alkaline stage in the presence of sufficient Ca ions with an effective amount of an alkaline liquor to effect displacement of metals from the chelated metal species and precipitation of the metals as solids in alkaline solution; removing the solids from the alkaline solution to provide a metal-free, chelating agent-containing solution; and recycling the metal-free solution to the pulp liquor.

8 Claims, 2 Drawing Sheets

PROCESSES OF RETAINING CHELANT-CONTAINING EFFLUENT WITHIN PULP BLEACH PLANTS

FIELD OF THE INVENTION

This invention relates to processes for retaining chelant-containing effluent within pulp bleach plants, particularly said effluent in total chloride-free bleaching sequence plants.

BACKGROUND OF THE INVENTION

Environmental concerns have led the pulp and paper industry to switch from chlorine bleaching to ECF (Element Chlorine-free) and TCF (Total Chlorine-free) bleaching processes. In TCF bleaching, oxygen-based chemicals, such as hydrogen peroxide and ozone, are used instead of chlorine-based chemicals. This eliminates the discharge of toxic AOXs. However, in the TCF bleaching process transition metals, especially Mn, Fe, and Cu, present in trace amounts in the pulp interfere with the process. Unfortunately, decomposition of hydrogen peroxide is dramatically catalysed by these transition metals and delignification selectivity reduced by transition metal induced radicals. Accordingly, this results in unnecessarily high consumption of bleach chemicals, low pulp brightness and weak pulp strength. Thus, it is highly desirable that transition metal concentration in TCF bleaching processes be controlled. In present practice, transition metals are removed from the pulp either by an acid stage (A stage) or chelation stage (Q stage), prior to the bleaching stage. The chelation treatment is preferred as it gives a better metal profile in the treated pulp for subsequent TCF bleach sequences.

Although unbleached pulp is generally treated in a separate chelation stage (Q stage), it is sometimes treated in an ozone-combined chelation stage, such as a (QZ) stage. In the chelation stage, unbleached pulp is treated with a chelating agent to remove transition metals from the pulp by formation of soluble metal-chelates. The chelated transition metal ions are purged through washing with the Q-stage effluent. The chelant-treated and washed pulp, which is substantially free of transition metals, is ready for the TCF bleach. However, an effluent which contains chelating agent as well as the chelated metals is produced. Typical chelating agents in common use are EDTA (ethylenediaminetetraacetate), DTPA (diethylenetriaminepentaacetate) and HEDTA (hydroxyethylethlenediarninetriacetate) salts.

In contrast to ECF bleach effluent, toxic AOXs are not present in TCF bleach effluent. However, Q stage effluent in a TCF bleaching process is a cause for concern in that in practice there is a difficulty in the removal of metals from the chelating agent in the effluent. Further, since chelating agents per se are not easily biodegraded, direct discharge of Q-stage effluent is not environmentally acceptable to streams or landfill. Accordingly, a most preferred solution to this pollution problem would be the elimination of the bleach plant effluent, to provide a TEF (Total Effluent Free) i.e. zero-effluent process, for example, by re-using the effluent in a closed-cycle.

However, one problem associated with such a closed-cycle pulp/bleach mill is the accumulation of non-process elements. Champion International (1) has developed a bleached filtrate recycle process for a ECF bleach sequence wherein non-process and non-chelated metals, such as Ca, Mg, Fe and Mn are removed either by precipitation or ion exchange from the chlorine dioxide (D) stage filtrate and chlorides removed in a chemical recovery plant. For TCF bleach, a closed-cycle bleach plant is preferred, technically in not having corrosive chlorides in the effluent. However, non-process metals still have to be removed from effluent, particularly from chelation-stage effluent, to avoid their accumulation. Such non-process metals found in chelant-containing effluent include, for example, (i) transition metals, such as Mn, Fe and Cu, and (ii) scalable metals such as Ca, Mg and Al. A plant trial run at a Louisiana-Pacific's mill having a TCF bleaching sequence demonstrated that non-process metals would accumulate to cause problems in the peroxide bleach stage if those metals were not removed before recycling in the plant (2).

U.S. Pat. No. 5,401,362—Lindberg, Hans G.—issued Mar. 28, 1995, describes the removal of transition metals from treatment fluids in pulp mills using, inter alia, chelating agents wherein transition metal-free chelant-containing effluent is recycled generally in the pulp mill. However, the problem of the effluent containing chelant is not acknowledged nor addressed and that emphasis is given to carbonate concentration in the metal precipitation step. Recycle and subsequent acidification to utilize the chelant agent to solubilize fresh metals is not described or taught.

PCT/SE94/00130—Sunds Defibrator Industries, published Oct. 13, 1994, discloses use of a chelant to solubilize metals which are subsequently precipitated after removal from the pulp by treatment with an alkaline liquor, which preferably also contains sulphide, for example, green liquor or white liquor. The resultant metal-free, but chelant-containing waste water is used as a washing water. There is no teaching of subsequent acidification for future metal chelation, or the role of dissolved calcium ion.

A published paper entitled "Strategies for Metal Removal Control in Closed Cycle Mills" International Pulp Bleaching Conference—Papers (1994), pages 293–302; Lindberg H. et al discloses a process for metal removal which only provides little or partial Mn removal from Q stage effluent (see FIGS. 8–10).

Thus, there remains a need for a process of removing not only undesirable transition metals from pulp bleach plants but also a need to recover those chelating-agents used in such plants to remove said transition metals.

SUMMARY OF THE INVENTION

It is an object of the present invention to provide a cost-effective and environmentally acceptable process of retaining chelating agents from pulp bleach plant effluent for continued use in the plant.

The invention, thus, provides a method of removing transition metals from a transition metal-containing digested pulp liquor wherein said digested pulp is to be bleached in a subsequent bleaching step and wherein said metals are removed by a chelating agent in a chelating agent closed re-cycle process.

Accordingly, the invention provides in one aspect a method of removing transition metals from a transition metal-containing digested pulp liquor wherein said digested pulp is to be bleached in a subsequent bleaching step, and wherein said metals are removed by a chelating agent in a chelating agent closed recycle process; said method comprising (a) treating a pulp liquor in an acidic stage with an effective chelating amount of a chelating agent to form a soluble, chelated metal species;

(b) removing said pulp to provide a chelated metal species-containing solution;

(c) treating said solution in an alkaline stage in the presence of Ca ions with an effective amount of an alkaline liquor to effect displacement of said metals from said chelated metal species and precipitation of said metals as solids in said alkaline solution;

(d) removing said solids from said alkaline solution to provide a metal-free, chelating agent-containing solution; and (e) recycling said metal-free solution to said pulp liquor of step (a).

Thus the invention provides apparatus and method for retaining chelate species-containing liquors in bleach plants wherein such chelate species are re-used to chelate metal ions in acid solutions. The acidic solutions may have a pH nearly as high as pH 7.

In a further aspect the method comprises (a) treating a pulp liquor in an acidic stage with an effective chelating amount of a chelating agent to form a soluble, chelated metal species;

(b) removing said pulp to provide a chelated metal species-containing solution;

(c) providing said solution with sufficient Ca ions (at least equimolar to the chelant) using Ca containing chemicals, preferably lime;

(d) treating said solution in the presence of Ca ions with an effective amount of an alkaline liquor to effect displacement of said metals from said chelated metal species and precipitation of said metals as solids in said alkaline solution;

(e) adding carbonate to said alkaline solution to precipitate the excess Ca ions, if there is any, as solids in said alkaline solution;

(f) removing said solids from said solution to provide a metal-free chelating agent-containing solution; and (g) recycling said metal-free solution to said pulp liquor of step (a), or to a subsequent bleach stage.

Ca ions in step (c) may come from any Ca-containing chemicals or plant effluent, preferably lime or quick lime, which provides both required Ca ions and hydroxyl ions for effective precipitation of metal solids. The alkaline liquor used in step (d) may be selected from sodium hydroxide, oxidized white liquor or alkaline plant effluent. Carbonate may be selected from $Na_2CO_3$, oxidized green liquor or $CO_2$.

Metal ions are generally difficult to remove from their chelated form by treatment with conventional inorganic bases such as NaOH and $Na_2CO_3$, because the chelated metal ions are thermodynamically more stable than their inorganic solid forms, as expressed by the following equation:

$$M_r(OH)_n\downarrow+EDTA^{4-}\rightarrow M_rEDTA^{(4-n)-}+nOH \quad (1)$$

According to metal-chelate stability constants, a metal having a higher stability constant will displace the metal having a lower stability constant. As shown in Eq. 2 chelated transition metals ($M_r$), such as Mn, Fe and Cu, transition metals displace chelated Ca in acidic and neutral conditions.

$$CaEDTA^{2-}+M_r^{n+}\rightarrow M_rEDTA^{(4-n)-}+Ca^{2+} \quad (2)$$

However, transition metal ($M_r$) hydroxides are much less soluble than calcium hydroxide and the formation of such transition metal hydroxides is thermodynamically favoured by Ca displacement of the transition metals under alkaline conditions, viz:

$$Ca^{2+}+M_rEDTA^{(4-n)-}+nOH\rightarrow CaEDTA^{2-}+M_r(OH)_n\downarrow \quad (3)$$

I have found that by providing Ca ions at least equimolar to the metal-chelant species, under alkaline conditions, transition metals are displaced by Ca as the metal species in the chelant. In above reactions (1–3) the chelating agent is represented by EDTA but are applicable with other chelating agents, such as DTPA, HEDTA, and the like used in the chelation stage. The process is applicable not only to transition metals such as Mn, Fe, Cu, Ni and Co, but also to other non-process metals such as Mg, Al and Zn. After metal species removal, free chelant is recovered under acidic conditions for further reaction with transition metal species in fresh pulp.

In the present invention, chelated transition metals and non-process metals other than Ca are removed from the effluent in the presence of Ca ions by basic, preferably, hydroxide precipitation under alkaline conditions of pH 9–12, preferably, pH 11–12. At this stage the treated effluent contains chelated Ca but is substantially free of transition metals (<0.1 mg/l) and other non-process metals. This is directly or indirectly acified prior to addition to or in the presence of new metal-containing pulp in the plant. Under acidic or near neutral conditions, for example, pH of 5–6 in a typical chelation stage (Q-stage), Ca-chelate acts as a free chelant with transition metals. Thus, chelating agent is recovered and re-used in the bleach plant for transition metals management.

To displace the metals from the metal-chelant complex, preferably, equal moles of Ca to the chelant are provided in the effluent. The Ca ions may either come from the addition of Ca containing entities, such as lime (CaO or $Ca(OH)_2$), or from the wood fibre from which the pulp is generated or other sources. Based on Ca availability, the effluent treatment processes may be classified as follows:

(1) For the effluent which contains no Ca ions or contains Ca less than the required amount wherein the molar ratio of Ca:Chelant<1, the Ca is provided with, preferably, lime—CaO or $Ca(OH)_2$. The effluent is mixed with sufficient lime and the pH adjusted, preferably, to 11–12, using NaOH for metal hydroxide precipitation. The metal solid precipitates are separated from the effluent and clear liquid recycled.

(2) It is quite common for the requisite amount of Ca to be present in bleach effluent,especially in the Q-stage effluent. For effluent containing sufficient Ca, no lime addition is required and the effluent is treated with NaOH to a pH of, preferably, 11–12 for metal hydroxide precipitation.

(3) In those cases where the bleach effluent contains a relatively high concentration of Ca ions, i.e. those amount of Ca which result in a molar ratio of Ca:chelant >1, the undesired excess free Ca ions are removed by carbonate precipitation. The effluent is first treated with NaOH to a pH of, preferably, 11–12 for metal hydroxide precipitation and followed by carbonate addition.

BRIEF DESCRIPTION OF THE DRAWINGS

In order that the invention may be better understood preferred embodiments will now be described by way of example only, with reference to the accompanying drawings wherein.

DETAILED DESCRIPTION OF PREFERRED EMBODIMENTS

Figure 1:
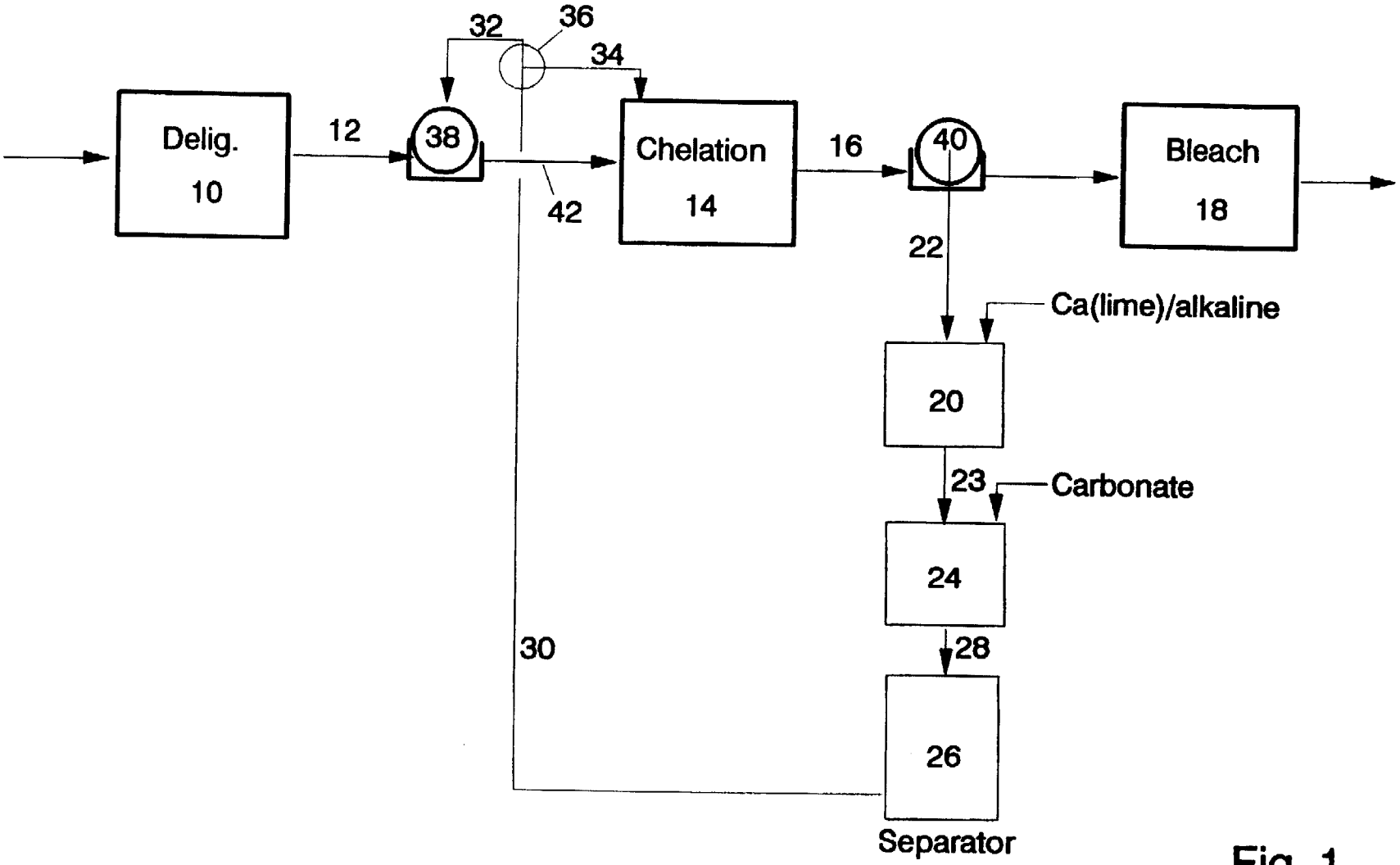
FIG. 1 is a schematic block diagram flow chart of a process according to the invention.

With reference to FIG. 1 unbleached pulp from an oxygen delignification (O) stage 10 is passed through line 12 and washer 38 to chelation-stage 14 where it is acidified to about pH 5. Sufficient chelation agent is, initially, at stage 14 added to solubilize transition metal and scaling metal ions with EDTA chelating-agent. After stage 14, the pulp is passed through line 16 and washed at 40, then directed to subsequent bleaching stage 18. Filtrate from chelation stage 14 is passed to precipitator 20 through line 22 where it is mixed with sodium hydroxide/Ca (lime) to a pH of, preferably, 11–12 to effect metal hydroxide precipitation. If there is an excess of calcium in the effluent as determined by analysis the aqueous mixture produced in precipitator 20 is passed along line 23 to precipitator 24 wherein any free calcium ions are precipitated by addition of carbonate. It should be noted that Ca removal is effected after the effluent has been made alkaline by sodium hydroxide in precipitator 20. Effluent with suspended precipitates is fed from precipitator 24 to separator 26 along line 28, where the precipitates of metal hydroxides and calcium carbonate are separated using a solid/liquid separation process, such as filtration. Chelant effluent, free of detrimental transition metals from separator 26, is fed through line 30 to either washer 38 through line 32 or directly to chelation stage 14 through line 34 and, respectively, lines 32 and 34 under the control of valve 36. Chelant returned to chelation stage 14 will solubilize further metals associated with fresh pulp received from stage 10.

The metal hydroxide precipitation process 20 must proceed prior to the calcium carbonate precipitation process 24 to ensure that there is sufficient calcium to complete transition metal hydroxide precipitation. Stages 20 and 24 can be separately conducted in individual mixing and retention tanks, or optionally, sequentially carried out in one precipitation tank in a batch operation. Chelation stage (Q-stage) may alternatively be a combined chelation stage, involving chelation and ozone (QZ-stage).

Figure 2:
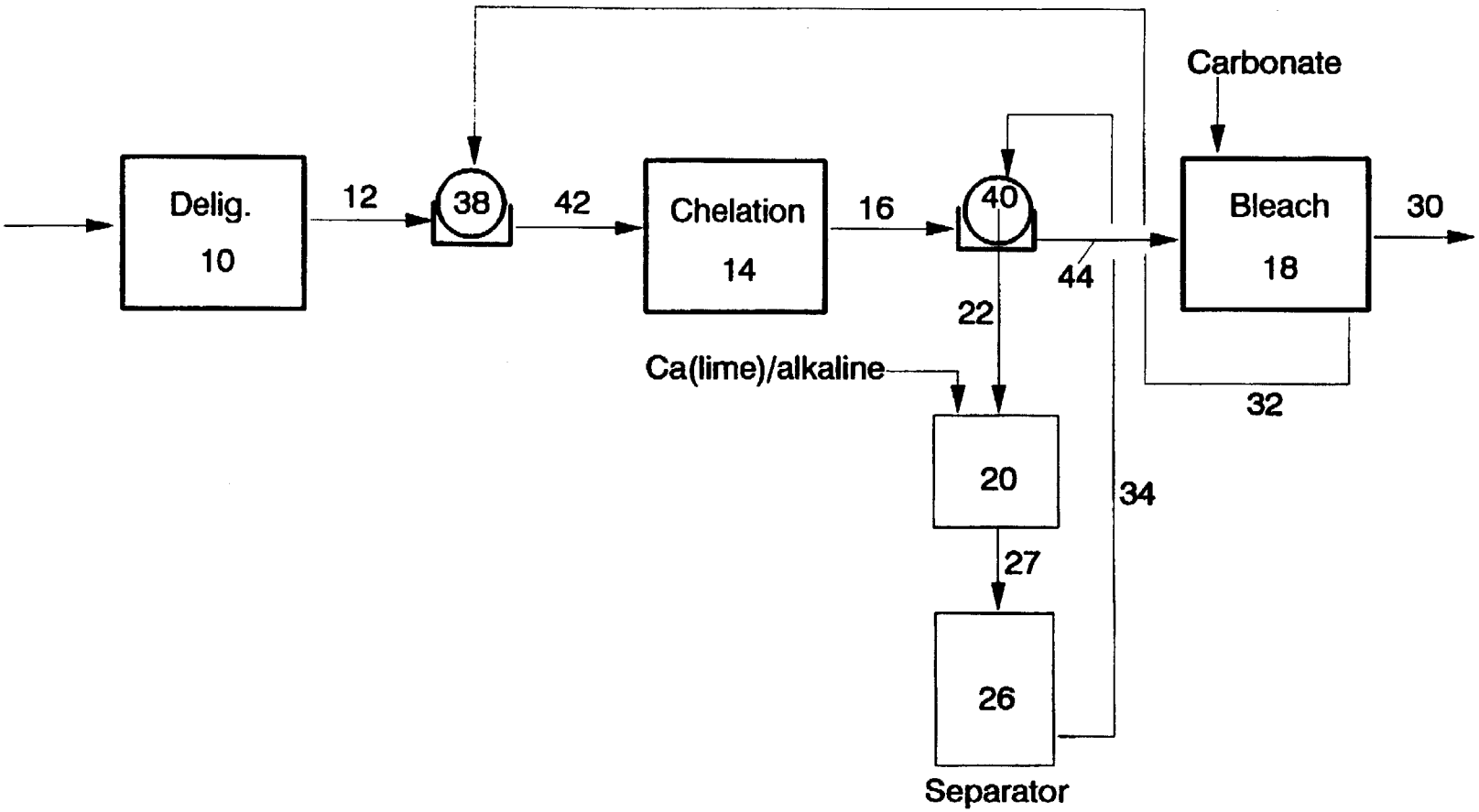
FIG. 2 is a schematic block diagram flow chart of an alternative process according to the invention.

With reference now to FIG. 2, this shows an alternative chelant containing effluent recycle system.

Unbleached pulp is fed to chelation stage 14 from stage 10, as hereinbefore described, wherein stage 14 is either a chelation stage or a combined chelation stage, such as a QZ-stage, where the pulp is treated with a chelant to remove transition metals. Chelant-treated pulp through washer 40, free of transition metals, is fed to bleaching stage 18, such as a hydrogen peroxide bleaching step (P-stage). Chelant-containing effluent from stage 14 is fed to precipitator stage 20 through line 22, where it is mixed with sodium hydroxide/Ca (lime) to a pH 11–12 for metal hydroxide precipitation. Effluent from stage 20 with suspended metal precipitates is directly fed to separator 26 through line 27 where the precipitates of metal hydroxide are separated and removed to provide a metal-free effluent. In this embodiment, excess Ca ions may be left in this clear effluent, which is directed to wash 40 through line 34. The displacement wash liquor enters bleach stage 18 through line 44. Sodium carbonate is added at bleach stage 18 to reduce excess calcium, which, in the form of calcium carbonate, is adsorbed on the fibre and carried away down fibre line 30. Effluent from bleach stage 18, containing the chelating agent, is directed to wash 38 through line 32, the displacement wash liquor is returned to chelation stage 14 through line 42.

Precipitation stage 20 in both FIGS. 1 & 2, and stage 24 in FIG. 1 are carried out at temperature in the range of 20°–90° C. At a typical temperature of 50°–90° C. for the effluent from stage 14, a satisfactory mixing time is 1–5 min and a retention time for precipitation is 0.5 to 60 min. Stage 20 preceeds stage 24 to ensure that there is enough Ca in the effluent to displace transition metals and effect metal hydroxide precipitation. The solid/liquid separation equipment of stage 26 can be a filter, clarifier, centrifuge or flotator.

The chemicals used for treating the effluents should be, most preferably, free of reducing agents such as sulphides. pH adjustment is, preferably, effected with NaOH, which is either virgin caustic soda or fully-oxidized white liquor. For free Ca reduction, the carbonate added may be virgin $Na_2CO_3$, fully-oxidized green liquor or generated from $CO_2$. Sources of Ca are preferably lime, which may be in the form of, for example, commercial CaO or $Ca(OH)_2$. Chelating agents, typically represented by EDTA, may be any chelant presently of use in mills, such as EDTA, DTPA, HEDTA and the like.

Reference is now made to the following examples.

EXAMPLE 1

Laboratory-made chelant-containing solutions were prepared for testing the efficiency transition metal removal.

The test solutions contained 8–12 mg/l Mn, 2–4 mg/l Fe, 1–2 mg/l Cu and 210–420 mg/l EDTA and had a pH of 6. Each of the test metal-chelant solutions was mixed with a $Ca(OH)_2$ slurry in a molar ratio of Ca:chelant>1, and NaOH subsequently added to pH 11.5–12. The solution was well-mixed for 5 min, settled for 60 min to cause metal hydroxide precipitation and the metal precipitates separated from the solution by filtration. The clear filtrate was analyzed for remaining metal content. The results are given in Table 1 and show that the chelated transition metals were effectively removed from solution.

TABLE 1

| Metal | Initial Solution, mg/l | Treated Solution, mg/l |
|---|---|---|
| Mn | 8–12 | <0.1 |
| Fe | 2–4 | <0.1 |
| Cu | 1–2 | 0.1–0.2 |

EXAMPLE 2

In addition to laboratory-made solutions, plant effluents from pulp mills were also used in the tests as follows.

Chelant-containing effluent was collected from the Q-stage of two pulp mills, designated as Mill A and Mill B. Mill A used DTPA in the chelation (Q) stage in a charge of 2.6 Kg/ton o.d. pulp. EDTA (0.5% on o.d. pulp) was used in Mill B. The effluent, as received, contained transition metals Mn, Fe and Cu, and other non-process metals such as Mg, Ca and Al.

Since the amount of Ca in Q-stage effluent is such that the molar ratio of Ca to chelating agent is greater than 1 there were sufficient Ca ions for the displacement of transition metals. Accordingly, the effluent was treated first with NaOH to affect metal hydroxide precipitation and the resultant mixture of liquid/solids subsequently treated with $Na_2CO_3$ addition for precipitation of the excess Ca. The treatments were carried out in the following sequential steps in a temperature range of 20–90 C: (1) adjusting pH to 11.0–12 using NaOH, mixing 1–5 min, retention for 0.5–60 min; (2) adding $10^{-3}$–$5\times10^{-3}$ M $Na_2CO_3$, 1–5-min mixing and 10–60 min retention; and (3) separating the precipitates from the liquid by filtration.

The results are listed in Table 2. It can be seen that the concentrations of transition metals were reduced to <0.1 mg/l and that other non-process metal concentrations were also reduced to very low levels. Ca concentration was reduced, and the Ca left in the clear treated effluent was in chelated form.

TABLE 2

Metal contents in as received and $NaOH/Na_2CO_3$ treated Q-stage effluent from Mill A and B

| | Metal Concentration, mg/L | | | |
|---|---|---|---|---|
| | As received | | $NaOH/Na_2CO_3$ treated | |
| Metal | Mill A | Mill B | Mill A | Mill B |
| Mn | 6.9 | 0.6 | <0.1 | <0.1 |
| Fe | 0.65 | 0.25 | <0.1 | <0.1 |
| Cu | 0.1 | 0.11 | <0.1 | <0.1 |
| Ca | 72 | 24 | 18 | 17 |
| Mg | 16 | 3.6 | <0.1 | <0.1 |
| Al | 0.68 | <0.1 | <0.1 | <0.1 |

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated.

I claim:

1. A method of removing transition metals from a transition metal-containing digested pulp slurry wherein said digested pulp is to be bleached in a subsequent bleaching step, and wherein said metals are removed by a chelating agent in a chelating agent closed re-cycle process; said method comprising (a) treating a pulp slurry in an acidic or near neutral stage with an effective chelating amount of a chelating agent to form a soluble, chelated metal species;

(b) removing said pulp to provide a chelated metal species-containing solution;

(c) treating said solution in an alkaline stage in the presence of sufficient Ca ions with an effective amount of an alkaline liquor to effect displacement of said metals from said chelated metal species and precipitation of said metals as solids in said alkaline solution;

(d) removing said solids from said alkaline solution to provide a metal-free, chelating agent-containing solution; and (e) recycling said chelating agent-containing solution to said pulp slurry of step (a), wherein said sufficient calcium is, at least, an amount equimolar to said chelating agent in said metal species containing solution, and provided by Ca-containing chemicals.

2. A method as defined in claim 1 wherein said alkaline liquor is selected from the group consisting of sodium hydroxide, lime, alkaline bleach plant effluent, oxidized white liquor and mixtures thereof.

3. A method as defined in claim 2 wherein said alkaline liquor is sodium hydroxide solution.

4. A method as defined in claim 1 wherein step (c) is carried out at a pH selected from 9–12.

5. A method as defined in claim 1 further comprising adding an effective amount of a carbonate to reduce Ca concentration by precipitation of calcium carbonate.

6. A method as defined in claim 5 wherein the carbonate is selected from $Na_2CO_3$, oxidized green liquor, $CO_2$ or mixtures thereof.

7. A method as defined in claim 1 wherein the metal-free chelating agent-containing-solution is reused as directed to the chelation stage, or directed to a subsequent bleaching stage.

8. A method as defined in claim 1 comprising (a) treating a pulp slurry in an acidic stage with an effective chelating amount of chelating agent to form a soluble, chelated metal species;

(b) removing said pulp to provide a chelated metal species-containing solution;

(c) providing said solution with sufficient Ca ions using Ca containing chemicals;

(d) treating said solution in the presence of Ca ions with an effective amount of an alkaline liquor to effect displacement of said metals from said chelated metal species and precipitation of said metals as solids in said alkaline solution;

(e) adding carbonate to said alkaline solution to precipitate excess Ca ions as solids in said alkaline solution;

(f) removing said solids from said solution to provide a metal-free chelating agent-containing solution; and (g) recycling said metal-free solution to said pulp slurry of step (a), or to a subsequent bleach stage.

* * * * *